US011437738B2

(12) United States Patent
Kumamoto

(10) Patent No.: US 11,437,738 B2
(45) Date of Patent: Sep. 6, 2022

(54) CONNECTOR WITH A HOUSING HAVING A CONFIRMATION WINDOW

(71) Applicant: Tyco Electronics Japan G.K., Kawasaki (JP)

(72) Inventor: Tadashi Kumamoto, Kanagawa (JP)

(73) Assignee: Tyco Electronics Japan G. K., Kawasaki (JP)

( * ) Notice: Subject to any disclaimer, the term of this patent is extended or adjusted under 35 U.S.C. 154(b) by 0 days.

(21) Appl. No.: 17/024,000

(22) Filed: Sep. 17, 2020

(65) Prior Publication Data

US 2021/0091482 A1 Mar. 25, 2021

(30) Foreign Application Priority Data

Sep. 20, 2019 (JP) ..... JP2019-171195

(51) Int. Cl.
*H01R 4/18* (2006.01)
*H01R 24/40* (2011.01)

(52) U.S. Cl.
CPC ..... *H01R 4/183* (2013.01); *H01R 24/40* (2013.01)

(58) Field of Classification Search
None
See application file for complete search history.

(56) References Cited

U.S. PATENT DOCUMENTS

| | | | | |
|---|---|---|---|---|
| 3,654,592 A * | 4/1972 | Primorac | ..... | H01R 12/721 439/637 |
| 6,120,333 A * | 9/2000 | Ko | ..... | H01R 4/185 439/748 |
| 6,565,396 B2 | 5/2003 | Saka et al. | | |
| 8,517,775 B1 * | 8/2013 | Wang | ..... | H01R 24/64 439/660 |
| 8,678,844 B2 | 3/2014 | Yoshisuji | | |

FOREIGN PATENT DOCUMENTS

| | | | |
|---|---|---|---|
| EP | 1168516 | A2 | 1/2002 |
| JP | 410973 | U | 1/1992 |
| JP | 2001351739 | A | 12/2001 |
| JP | 2003223960 | A | 8/2003 |
| JP | 2007123365 | A | 5/2007 |
| JP | 2012212658 | A | 11/2012 |
| JP | 201486169 | A | 5/2014 |

OTHER PUBLICATIONS

Abstract of JP 2007123365, dated May 17, 2007, 2 pages.
Abstract of JP 2003223960, dated Aug. 8, 2003, 1 page.
European Search Report, dated Feb. 18, 2021, 5 pages.

* cited by examiner

*Primary Examiner* — Ross N Gushi
(74) *Attorney, Agent, or Firm* — Barley Snyder

(57) ABSTRACT

A connector includes a contact and a housing having a first confirmation window. The contact is not visible through the first confirmation window prior to reaching a predetermined plug-in reference position upon being plugged into the housing. A front end of the contact is visible though the first confirmation window upon reaching the predetermined plug-in reference position.

16 Claims, 4 Drawing Sheets

CONNECTOR WITH A HOUSING HAVING A CONFIRMATION WINDOW

CROSS-REFERENCE TO RELATED APPLICATION

This application claims the benefit of the filing date under 35 U.S.C. § 119(a)-(d) of Japanese Patent Application No. 2019-171195, filed on Sep. 20, 2019.

FIELD OF THE INVENTION

The present invention relates to a connector and, more particularly, to a connector with a housing and a contact plugged in the housing.

BACKGROUND

When a connector is assembled, one of important points in assembly is to plug in a contact to a plug-in reference position inside a housing. Japanese Patent Application No. 2003-223960A discloses a connector having a window hole for plugging-in detection formed in a position of a housing where an electric wire connected to a terminal metal fitting or a part of the terminal metal fitting is visible. In JP 2003-223960A, when plugging in of the terminal metal fitting has been advanced and the electric wire crimped to the terminal metal wire or a part of the terminal metal fitting has become visible from the window hole for plugging-in detection, the contact is regarded as having been plugged in to a proper position.

Crimping, however, involves a mechanically-crushing step, and thus the length of a crimped portion after crimping may vary for each terminal metal fitting. Therefore, high-accuracy plugging-in detection is difficult using the window hole for plugging-in detection in JP 2003-223960A.

SUMMARY

A connector includes a contact and a housing having a first confirmation window. The contact is not visible through the first confirmation window prior to reaching a predetermined plug-in reference position upon being plugged into the housing. A front end of the contact is visible though the first confirmation window upon reaching the predetermined plug-in reference position.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
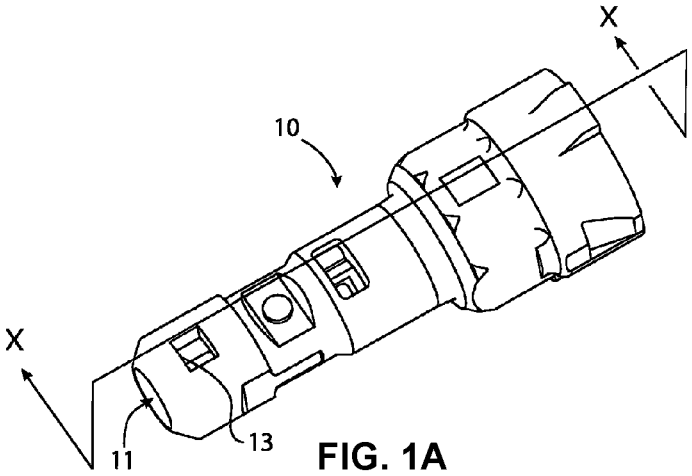
FIG. 1A is a perspective view of a housing according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will convey the concept of the disclosure to those skilled in the art.

Figure 1B:
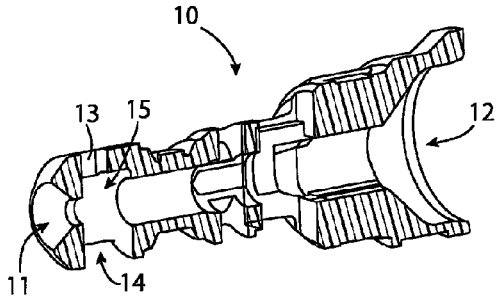
FIG. 1B is a sectional perspective view of the housing, taken along line X-X in FIG. 1A.

A housing 10 according to an embodiment is shown in FIGS. 1A and 1B. A mating opening 11 from which a male contact that is a mating contact is plugged in is formed in a front end of the housing 10. In addition, an assembly opening 12 from which a female contact 20, shown in FIG. 2A, that is incorporated into the housing 10 to constitute the connector together with the housing 10 is plugged in is formed in a rear end of the housing 10.

The housing 10, as shown in FIGS. 1A and 1B, has a first confirmation window 13 formed in the housing 10. The first confirmation window 13 is a window for confirming that the female contact 20 has been plugged in to a predetermined plug-in reference position within the housing 10. Specifically, when the female contact 20 is plugged in from the assembly opening 12, no part of the female contact 20 is visible from the first confirmation window 13 before the female contact 20 reaches the predetermined plug-in reference position.

Figure 2A:
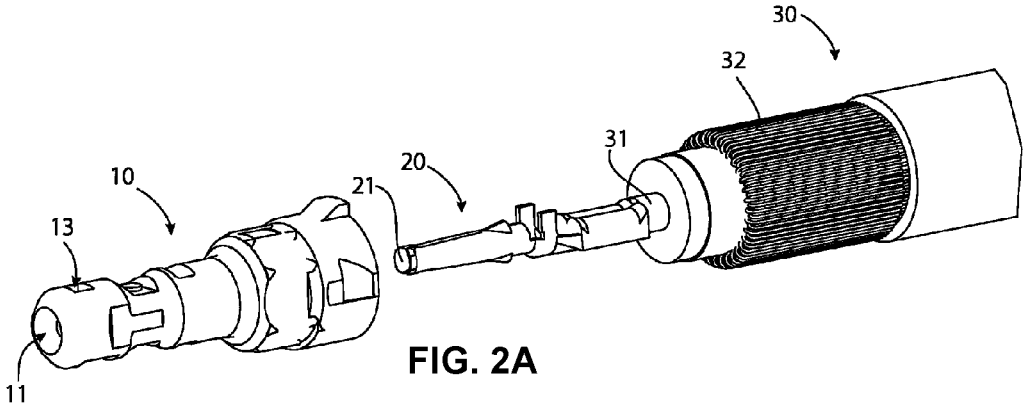
FIG. 2A is a perspective view of the housing and a female contact on an electric wire before plugging.
Figure 2B:
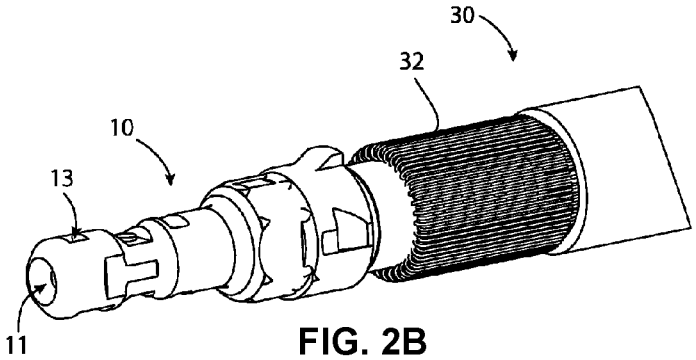
FIG. 2B is a perspective view of the housing and the female contact on the electric wire after plugging.
Figure 3A:
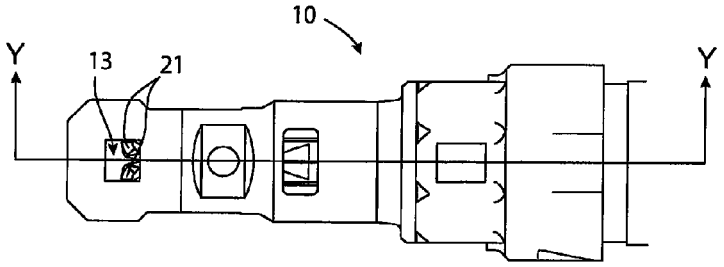
FIG. 3A is a top view of the housing with the female contact inserted.
Figure 3B:
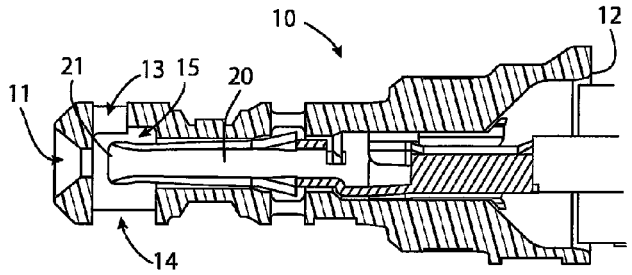
FIG. 3B is a sectional top view of the housing with the female contact inserted, taken along line Y-Y of FIG. 3A.

When the female contact 20 reaches the plug-in reference position, shown in FIGS. 2B, 3A, and 3B, the front end 21 of the female contact 20 becomes visible from the first confirmation window 13, as shown in FIG. 3A. That is, the first confirmation window 13 is formed in a position where, if any part of the front end 21 of the female contact 20 is visible, it means that the female contact 20 has reached the plug-in reference position having a predetermined allowable range; the fact that the front end 21 of the female contact 20 is visible from the first confirmation window 13 confirms that the female contact 20 has been plugged in properly. Therefore, only recognizing a binary presence or absence of the contact 20 at the first confirmation window 13, namely whether there is a change or not, is necessary, and thus misrecognition is unlikely.

The housing 10 has an extraction hole 14, shown in FIG. 1B, for a manufacturing die. The female contact 20 plugged into the housing 10 is pressed by the mating male contact when the male contact is plugged in, and required to open the front end 21. Therefore, the housing 10 is required to have a space 15 having a size allowing the front end 21 of the female contact 20 to open. The extraction hole 14 is an extraction hole for a die for forming this space 15.

The front end 21 of the female contact 20 plugged in is also visible from the extraction hole 14, as shown in FIG. 3B. However, the space 15 is required to extend to a position receding from the front end 21 of the female contact 20. Assume that this extraction hole 14 is substituted for the confirmation window; in that case, it is necessary not to judge whether or not the front end 21 of the female contact 20 is visible from the extraction hole 14, but to measure a dimension of a visible part of the female contact 20 and judge whether or not the female contact 20 has been plugged in to the plug-in reference position. Therefore, in the present embodiment, the first confirmation window 13 is formed separately from this extraction hole 14.

The female contact 20 is shown before plugging in to the housing 10 in FIG. 2A and is shown after plugging into the housing 10 in FIG. 2B. As shown in FIG. 2A, an electric wire 30 used here is a coaxial cable having a core wire 31 and a shielding wire 32. The core wire 31 of the electric wire 30 is connected by crimping to the female contact 20. The female contact 20 connected to the electric wire 30 is plugged in from the assembly opening 12 of the housing 10, shown in FIG. 1B, to a position shown in FIG. 2B.

Figure 4:
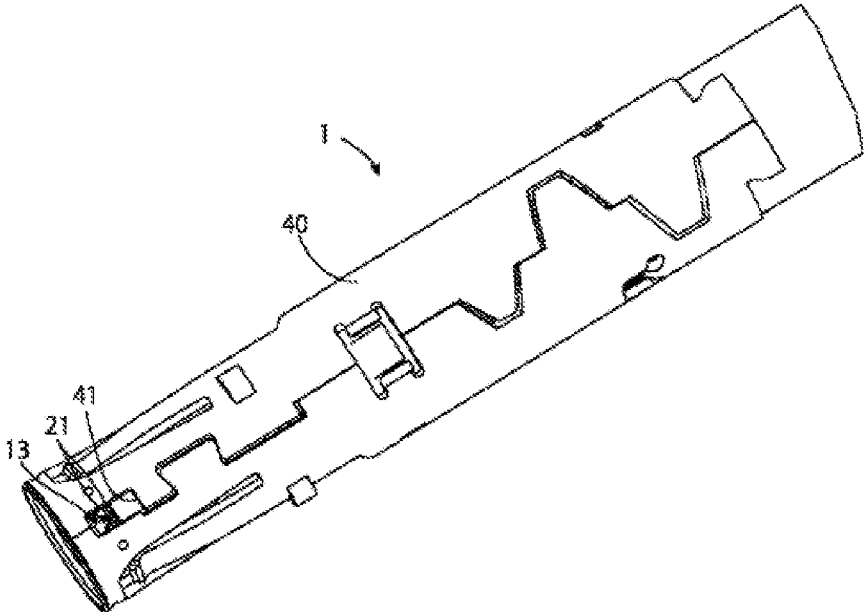
FIG. 4 is a perspective view of a connector according to an embodiment.

In a connector 1 according to an embodiment, as shown in FIG. 4, the housing 10 described above is covered with an outer conductor 40 for shielding. The outer conductor 40 is electrically connected to the shielding wire 32 of the electric wire 30 shown in FIGS. 2A and 2B. When the connector 1 shown in FIG. 4 is assembled, an assembly procedure in which the female contact 20 is plugged into the housing 10 covered with the outer conductor 40 is also conceivable. Therefore, in the connector 1 of the present embodiment, a second confirmation window 41 overlapping the first confirmation window 13 of the housing 10 is formed in this outer conductor 40. This enables confirmation of the front end 21 of the female contact 20 plugged in to the proper position from the second confirmation window 41 through the first confirmation window 13 even when the housing 10 is covered with the outer conductor 40. The first contact 20 may be plugged in after the outer conductor 40 is attached to the housing 10, and thus assembly work becomes more flexible.

It should be noted that, though the connector 1 of a type provided with the outer conductor 40 has been described herein, the present invention is also applicable to a connector of a type without the outer conductor 40. In addition, though the connector 1 of a type provided with the female contact 20 has been described herein, the type of the contact does not matter to the present invention, and the present invention is also applicable to a connector 1 of a type provided with a male contact.

The connector 1 enables high-accuracy confirmation of whether or not the contact 20 has been plugged in to the predetermined plug-in reference position of the housing 10. The first confirmation window 13 from which the front end 21 of the contact 20 is visible. This enables higher-accuracy confirmation than confirming a crimped portion formed by mechanical plastic deformation, namely crushing, thus having a variable length, or the electric wire 30 adjoining the crimped portion.

What is claimed is:

1. A connector, comprising:

a contact; and a housing having a first confirmation window, the contact is not visible through the first confirmation window until reaching a predetermined plug-in reference position upon being plugged into the housing, a front end of the contact is visible through the first confirmation window upon reaching the predetermined plug-in reference position in which the contact is properly plugged into and secured in the housing.

2. The connector of claim 1, further comprising an outer conductor covering the housing.

3. The connector of claim 2, wherein the outer conductor has a second confirmation window overlapping the first confirmation window.

4. The connector of claim 1, wherein the contact is connected to an electric wire.

5. The connector of claim 4, wherein the contact is crimped to a core wire of the electric wire.

6. The connector of claim 5, wherein the electric wire has a shielding wire around the core wire.

7. The connector of claim 1, wherein the housing has a rear end with an assembly opening for plugging in the contact.

8. The connector of claim 7, wherein the housing has a front end with a mating opening for plugging in a mating contact.

9. The connector of claim 1, wherein the housing has an extraction hole positioned opposite the first confirmation window.

10. The connector of claim 9, wherein the extraction hole is larger than the first confirmation window.

11. The connector of claim 10, wherein the front end of the contact is visible through the extraction hole prior to reaching the predetermined plug-in reference position.

12. The connector of claim 10, wherein the predetermined plug-in reference position cannot be confirmed only by visibility of the front end of the contact through the extraction hole.

13. A connector, comprising:

an electric wire having a core wire and a shielding wire around the core wire;

a contact connected to the electric wire, the contact is crimped to the core wire; and a housing having a first confirmation window, the contact is not visible through the first confirmation window prior to reaching a predetermined plug-in reference position upon being plugged into the housing, a front end of the contact is visible through the first confirmation window upon reaching the predetermined plug-in reference position.

14. A connector, comprising:

a contact; and a housing having a first confirmation window, the contact is not visible through the first confirmation window prior to reaching a predetermined plug-in reference position upon being plugged into the housing, a front end of the contact is visible through the first confirmation window upon reaching the predetermined plug-in reference position in which the contact is properly plugged into the housing, the housing has an extraction hole positioned opposite the first confirmation window, the extraction hole is larger than the first confirmation window.

15. The connector of claim 14, wherein the front end of the contact is visible through the extraction hole prior to reaching the predetermined plug-in reference position.

16. The connector of claim 14, wherein the predetermined plug-in reference position cannot be confirmed only by visibility of the front end of the contact through the extraction hole.

* * * * *